US006032479A

United States Patent [19]

Choi et al.

[11] Patent Number: 6,032,479

[45] Date of Patent: Mar. 7, 2000

[54] FAN DUCT FOR A WINDOW-MOUNTED AIR CONDITIONER

[75] Inventors: Weon-Seok Choi, Seoul; Sang-Bom Park, Kyungki-do, both of Rep. of Korea

[73] Assignee: Samsung Electronics Co., Ltd., Suwon, Rep. of Korea

[21] Appl. No.: 09/159,783

[22] Filed: Sep. 24, 1998

[30] Foreign Application Priority Data

Jan. 20, 1998 [KR] Rep. of Korea ..... 98-1597

[51] Int. Cl.[7] ..... F25D 23/12

[52] U.S. Cl. ..... 62/262; 415/208.1

[58] Field of Search ..... 62/262; 415/206, 415/208.1, 208.2, 208.3, 914

[56] References Cited

U.S. PATENT DOCUMENTS 2,868,440 1/1959 McMahan ..... 230/130

4,944,654 7/1990 Chou et al. .

5,462,404 10/1995 Durth ..... 415/183

5,775,123 7/1998 Wakayama et al. ..... 62/407

*Primary Examiner*—Henry Bennett

*Assistant Examiner*—Melvin Jones

*Attorney, Agent, or Firm*—Burns, Doane, Swecker & Mathis, L.L.P.

[57] ABSTRACT

A window-mounted air conditioner has indoor and outdoor heat exchangers associated with respective first and second fans, and a duct for forming an air passage. One part of the air passage has a larger cross sectional area than another part thereof disposed upstream of the one part. A guide blade is positioned in the one part to divide the one part into sections so that the velocity and pressure of air flowing through the one part is substantially the same as the velocity and pressure of air flowing through the other part.

6 Claims, 3 Drawing Sheets

FAN DUCT FOR A WINDOW-MOUNTED AIR CONDITIONER

BACKGROUND OF THE INVENTION

1. Field of the Invention

The present invention relates to a window-mounted type air conditioner, and more particularly, to an air-circulation fan arrangement of such an air conditioner.

2. Prior Art

A window-mounted type air conditioner has an outdoor heat exchanger (called a condenser) which is installed at the outer side of a window and used in condensing a compressed refrigerant, and an indoor heat exchanger (called an evaporator) which is installed at the inner side of the window and used in evaporating a refrigerant condensed in the outdoor heat exchanger so as to absorb heat of ambient room air.

The appearance of the body of such a window-mounted type air conditioner is formed by a front cover, rear cabinet, and a base.

The front cover has a suction grill through which room air is drawn into the air conditioner, and a discharge grill for discharging cool air.

The indoor heat exchanger and the outdoor heat exchanger are disposed on a base and are spaced from each other at a predetermined distance. Between the indoor heat exchanger and the outdoor heat exchanger is disposed a duct having a passage for air flow. The duct 60 has, as shown in FIG. 1, guides 61*a* and 62*a* for forming a scroll type air passage. The reference numeral 71 shown in the figures is a cross-flow fan (hereinbelow, referred to as a 'first fan'). The first fan 71 is assembled to a shaft 70*a* of a fan motor disposed on an appropriate position in the duct 60. As the first fan 71 rotates, outside air which is in the room is drawn into the first fan 71 along the axis thereof, and then discharged along the outer circumference thereof. The discharged air is guided by the air passage of the duct 60 so as to be discharged into the room through the discharge grill of the front cover. In such a situation, the discharged air is cool air which has been cooled while it passes through the indoor heat exchanger.

Meanwhile, at the opposite side of the fan motor is installed a second fan facing the outdoor heat exchanger. Furthermore, on a side of the base, a compressor is mounted for compressing the refrigerant into a refrigerant of high temperature and pressure.

The refrigerant which has passed through the indoor heat exchanger is compressed by the compressor to a high temperature and pressure, and the compressed refrigerant exchanges heat with the ambient air of room temperature in the outdoor heat exchanger. The liquid refrigerant of room temperature and high pressure which has undergone such a heat exchange process is reduced in pressure by a capillary tube, and then flows into the indoor heat exchanger.

Meanwhile, the air in the room which is drawn through the suction grill by the first fan 71 flows into the indoor heat exchanger. The drawn air is cooled while it passes through the indoor heat exchanger. The cooled air flows along the air passage of the duct 60 by the first fan 71 and then is discharged into the room thereby through the discharge grill.

However, in the general window-mounted type air conditioner having such a construction, the sectional area A1 of a part 60*a* of the air passage formed by the duct 60 is broad, while the sectional area A2 of another part 60*b* of the air passage (located upstream of the part 60*a*) formed by the duct 60 is narrow.

Therefore, when the first fan 71 rotates to draw and discharge the outside air, a lot of air traverses the broad air passage, but a small amount of air traverses the narrow air passage since the pressure of air therein is low. Even worse, some of the air being discharged from the area A1 reenters the narrow air passage as shown at R in FIG. 2. This is because the velocity of the air flowing through the passage having broad sectional area A1 is low, while the velocity of the air flowing through the passage having narrow sectional area A2 is relatively high. Thus, a part of the slow air is inhaled into the passage of the fast air.

Such an inverse flow of the air causes a noises, a lowering of the cooling capacity versus size, and increase of the power consumption, so an improvement thereon is desired.

SUMMARY OF THE INVENTION

The present invention has been proposed to overcome the above described problems in the prior art, and accordingly it is an object of the present invention to provide a window-mounted type air conditioner having improved structure of the air passage so as to be capable of preventing a backflow of air and discharging the cool air with a uniform velocity across the overall area of the discharge grill.

To achieve the above object, the present invention provides an window-mounted type air conditioner comprising: a body comprising a front cover, a rear cabinet, and a base. The front cover includes an air discharge grill. An indoor heat exchanger is disposed on a front portion of the base, and an outdoor heat exchanger is disposed on a rear portion of the base. A compressor is installed on the base, and a fan motor is disposed between the indoor heat exchanger and the outdoor heat exchanger. The fan motor is connected to a first fan located adjacent the indoor heat exchanger, and a second fan located adjacent to the outdoor heat exchanger. A duct is disposed between the first fan and the indoor heat exchanger. The duct forms an air passage extending around an outer periphery of the first fan for guiding air drawn-in by the first fan toward the discharge grill. One part of the passage has a larger cross-sectional area than another part of the passage located upstream of the one part. A restriction is disposed in the one part for increasing velocity and reducing pressure of air passing through the one part, thereby making the velocity and pressure of air flowing through the one part substantially the same as the velocity and pressure of air flowing through the second part.

Preferably, the restriction comprises at least one guide blade installed in the one part of the passage for dividing the one part into smaller sections. Preferably, the guide blade is disposed substantially on a line coinciding with a radius of the first fan.

In such a window-mounted type air conditioner, the air drawn by the first fan is cooled while it flows through the indoor heat exchanger, and then is discharged into the room through the air passage and the discharge grill. The air is discharged with uniform pressure and velocity by the guide blade installed in the air passage, so the velocity of the discharged air becomes uniform across the overall area of the discharge grill. Therefore, the cool air can be stably discharged and a back-flow of the cool air can be prevented. Furthermore, since back-flow of the cool air is prevented, noise is reduced and the power consumption can be reduced in comparison with the cooling capacity.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, a preferred embodiment of the present invention will be described in detail with reference to the drawings.

Figure 1:
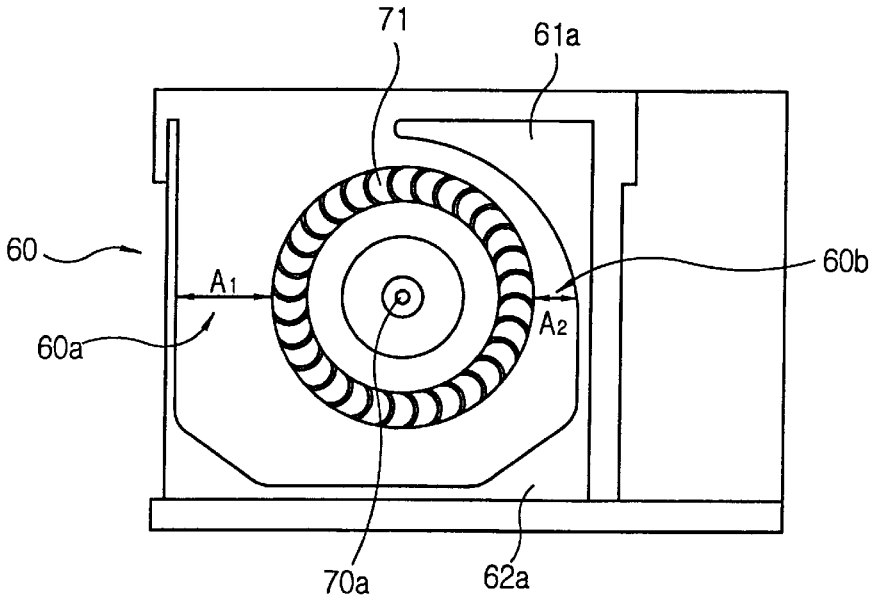
FIG. 1 (PRIOR ART)
FIG. 1 is a front view of a fan duct of a prior art window-mounted type air conditioner.
Figure 2:
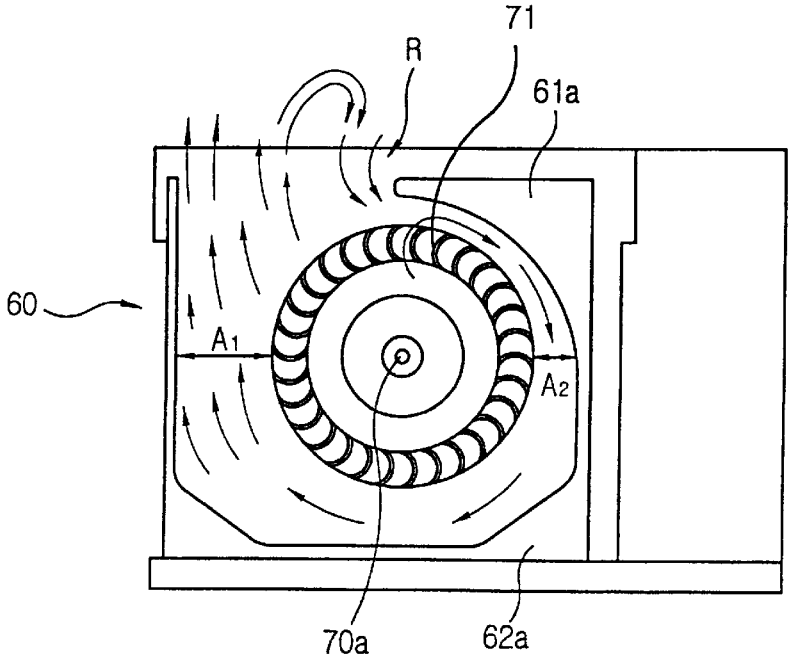
FIG. 2 (PRIOR ART)
FIG. 2 is a view similar to FIG. 1 showing the flow of air in the duct.
Figure 3:
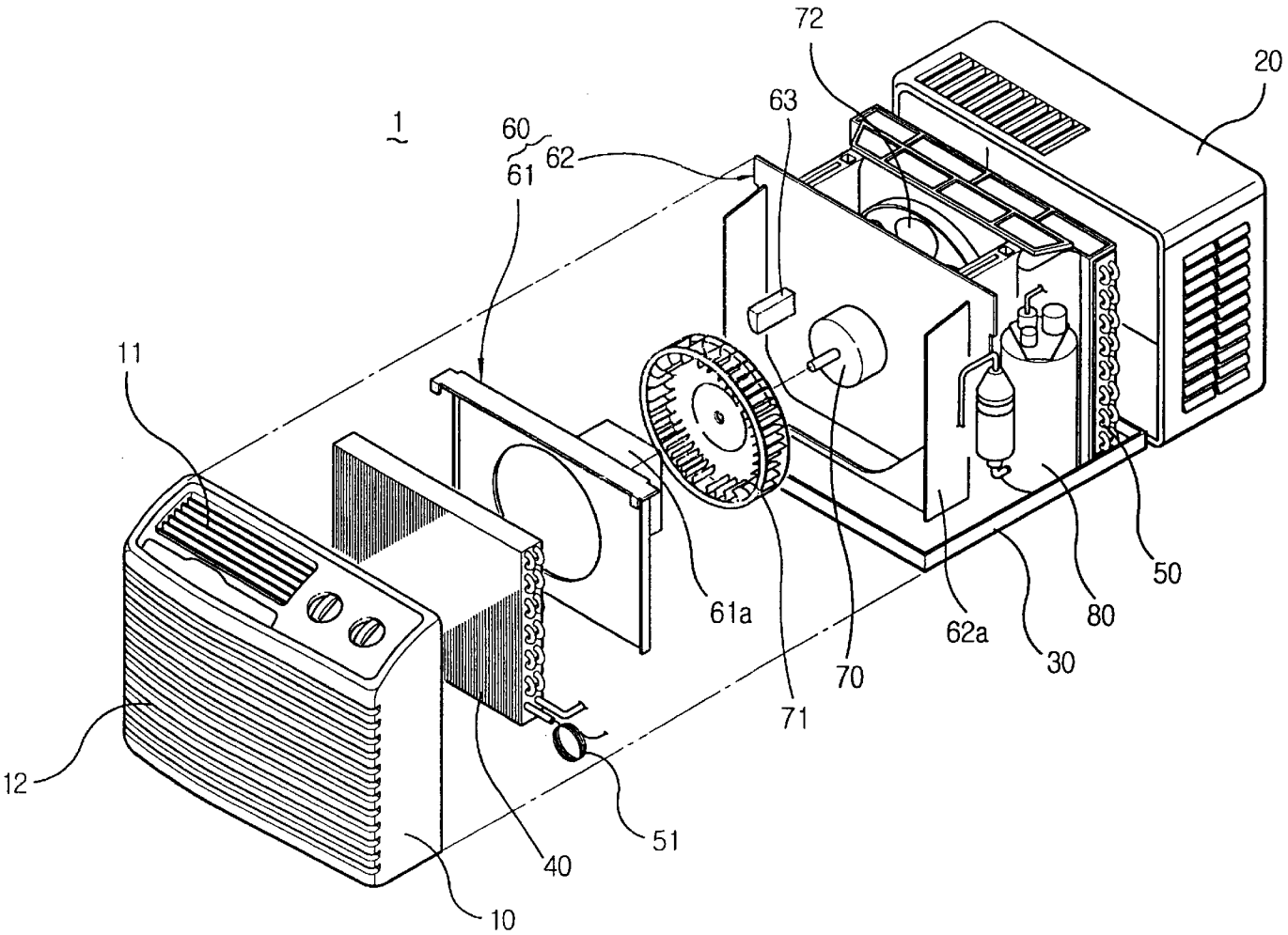
FIG. 3 is an exploded top perspective view of a window-mounted type air conditioner according to a preferred embodiment of the present invention.
Figure 4:
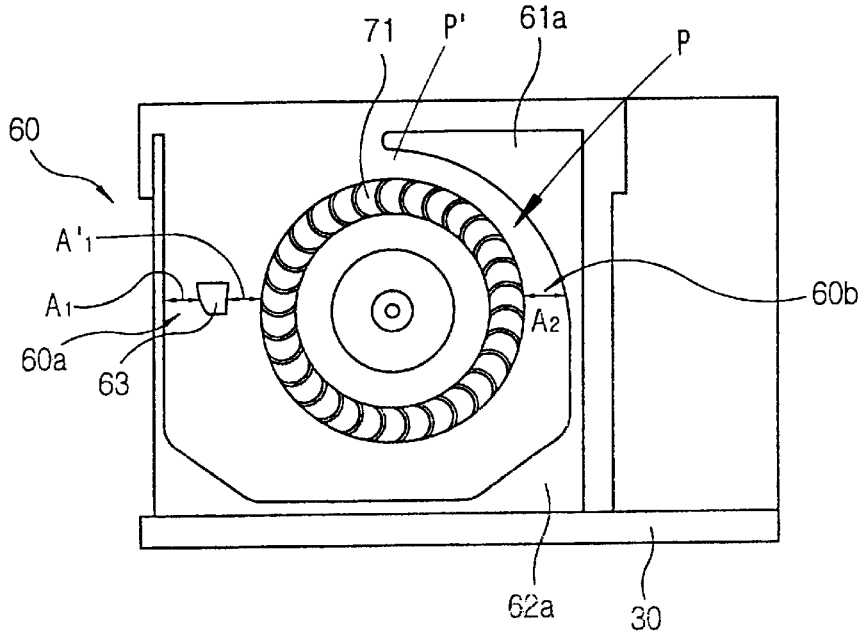
FIG. 4 is a front view of a fan duct of the window-mounted type air conditioner shown in FIG. 3.

FIG. 3 is an enlarged perspective view of a window-mounted type air conditioner according to a preferred embodiment of the present invention. In the description of the present embodiment, the same parts with the parts of the conventional air conditioner shown in FIGS. 1 and 2 will be referred to with the same reference numerals.

As shown, the appearance of the body 1 of such a window-mounted type air conditioner is formed by a front cover 10, a rear cabinet 20, and a base 30.

The front cover 10 has a front suction grill 12 through which room air is drawn into the air conditioner and a top discharge grill 11 for discharging cool air toward the room is formed at the upper part of the front cover 10.

The indoor heat exchanger 40 and the outdoor heat exchanger 50 are disposed on the base 30 while spaced from each other at a predetermined distance. The heat exchangers 40 and 50 are connected with each other through a capillary tube 51. Between the indoor heat exchanger 40 and the outdoor heat exchanger 50 is disposed a duct 60 having a generally annularly extending passage for air flow. The duct 60 is comprised of two plates 61 and 62. The plates 61 and 62 have guides 61*a* and 62*a* respectively, which are formed together therewith. The upper part of the air passage communicates with the discharge grill 11 of the front cover 10. Therefore, the air which has been cooled while it passes through the indoor heat exchanger 40 is discharged into the room through the discharge grill 11.

On the plate 62 of the duct 60, a restriction in the form of at least one guide blade 63 is installed. The guide blade 63 divides the part 60*a* of the air passage which is broader than the other part 60*b* of the passage into two separate sections 160*a* and 160*a'* having the same sectional areas A1 and A'1 as one another so that the velocities of the air flowing therethrough are equal and increased as compared with FIG. 1. The velocity and the pressure of the air flowing through the parts 60*a*, 60*b* are made substantially uniform by the guide blade 63. Therefore, no reentry of air into an upstream end P' of the passage and thus into the other air passage part 60*b* having narrow sectional area occurs (as occurs at R in the prior art depicted in FIG. 2), and thereby the velocity of the discharged air becomes uniform across the overall area of the discharge grill 11.

In such a situation, the guide blade 63 is disposed on a line extending generally radially from the axis of the first fan 71, and one or both sides of the guide blade 63 is curved in order to reduce resistance to air flow.

At a central part of the second plate 62 of the duct 60 is installed a fan motor 70.

The first fan 71 facing the indoor heat exchanger 40 is installed at one side of the fan motor 70, and a second fan 72 facing the outdoor heat exchanger 50 is installed on the other side of the fan motor 70. A compressor 80 for compressing the refrigerant to high pressure and temperature is installed on a side of the base 30.

The compressor 80 compresses the gaseous refrigerant therein by a reciprocating movement of a piston or a rotational movement of a rotor. The compressed refrigerant flows into the outdoor heat exchanger 50. The liquid refrigerant at room temperature and high pressure which has undergone heat exchange is reduced in pressure by the capillary tube 51, and then flows into the indoor heat exchanger 40.

Meanwhile, the air in the room drawn through the suction grill 12 by the first fan 71 flows toward the indoor heat exchanger 40. The air is then cooled while it passes through the heat exchanger 40. The cooled air is drawn by the first fan 71, and is then discharged through the air passage of the duct 60 and the discharge grill 11, whereby the temperature in the room is maintained low.

The operation of such an air conditioner is substantially the same with that of a prior art air conditioner, except that in the air conditioner according to the present invention, since the guide blade 63 for distributing the air is installed in the part 60*a* of the air passage having broad sectional area, the air flowing through the parts 60*a*, 60*b* has substantially the same velocity and pressure.

In other words, due to the presence of the guide blade 63, the pressure of the air passing through the part 60*a* of the air passage becomes low and the velocity thereof becomes relatively fast.

Figure 5:
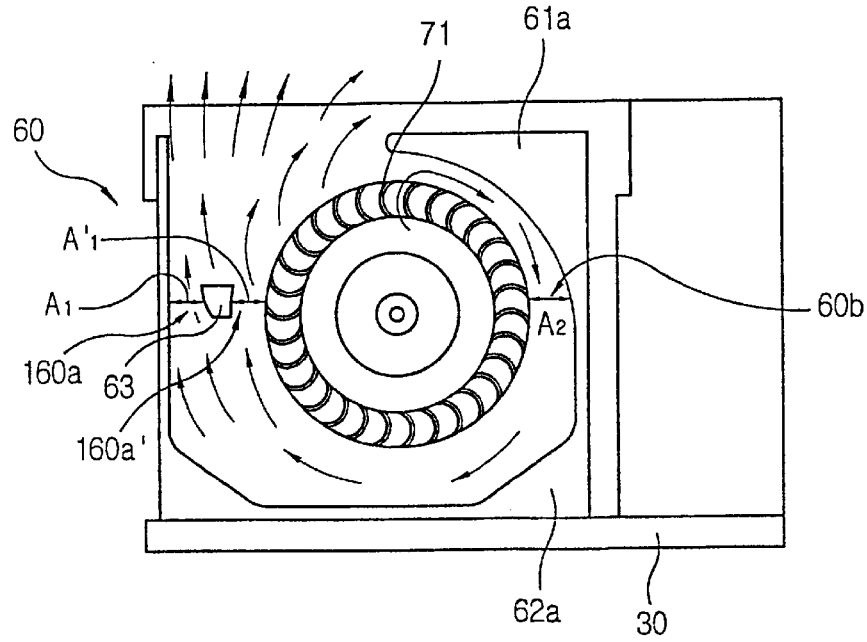
FIG. 5 is a view similar to FIG. 4 showing the flow of air in the duct.

Consequently, as shown in FIG. 5, the pressures and the velocities of the air flowing through the parts 60*a*, 60*b* of the air passage at both sides of the duct 60 are uniform while the cool air is discharged, so that a reentry of the discharged air into the passage is prevented and the velocity of the discharged air becomes uniform across the overall area of the discharge grill 11.

Although the preferred embodiment of the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A window-mounted air conditioner comprising:

a body comprising a front cover, a rear cabinet, and a base, said front cover including an air discharge grill;

an indoor heat exchanger disposed on a front portion of said base;

an outdoor heat exchanger disposed on a rear portion of said base;

a compressor installed on said base;

a first fan arranged to rotate about an axis for circulating air through said indoor heat exchanger;

a second fan arranged for circulating air through said outdoor heat exchanger;

a fan motor disposed between said indoor heat exchanger and said outdoor heat exchanger, said fan motor being connected to said first fan and said second fan; and a duct disposed between said first fan and said indoor heat exchanger, said duct forming an air passage extending generally annularly around an outer periphery of said first fan for guiding air drawn-in by said first fan toward said discharge grill, said passage including an upstream end and a downstream end, one part of said passage having a larger cross sectional area than another part of said passage located upstream of said one part, a restriction disposed in said one part for increasing a velocity and reducing a pressure of air passing through said one part, said restriction spaced angularly from said upstream end of said passage by less than 360° in a direction of rotation of said first fan.

2. The air conditioner as claimed in claim 1, wherein said restriction comprises at least one guide blade installed in said one part of said passage for dividing said one part into smaller sections.

3. The air conditioner as claimed in claim 2, wherein said guide blade is disposed on a line coinciding with a radius of said first fan.

4. The air conditioner as claimed in claim 2, wherein at least one side of said guide blade is curved.

5. The air conditioner as claimed in claim 4, wherein said one side of said guide blade is concavely curved, and an opposite side thereof is convexly curved.

6. The air conditioner according to claim 1 wherein said restriction is arranged for making said velocity and pressure the same as a velocity and a pressure of air flowing through said second part.

* * * * *